US006786501B2

(12) United States Patent
Derisoud et al.

(10) Patent No.: US 6,786,501 B2
(45) Date of Patent: Sep. 7, 2004

(54) DEVICE FOR ADJUSTING THE POSITION OF A BINDING FOR SECURING A BOOT TO A GLIDING BOARD

(75) Inventors: David Derisoud, Nevers (FR); Christian Lucas, Nevers (FR); Frédéric Farges, Nevers (FR)

(73) Assignee: Look Fixations S.A., Nevers (FR)

( * ) Notice: Subject to any disclaimer, the term of this patent is extended or adjusted under 35 U.S.C. 154(b) by 5 days.

(21) Appl. No.: 10/318,871

(22) Filed: Dec. 13, 2002

(65) Prior Publication Data

US 2003/0116942 A1 Jun. 26, 2003

(30) Foreign Application Priority Data

Dec. 20, 2001 (FR) ..... 01 16521

(51) Int. Cl.[7] ..... A63C 9/10
(52) U.S. Cl. ..... 280/623
(58) Field of Search ..... 280/623, 631, 280/632, 633, 624, 625, 626, 629, 634, 635, 617, 616, 607, 618

(56) References Cited

U.S. PATENT DOCUMENTS

| | | | | | |
|---|---|---|---|---|---|
| 3,531,135 | A | * | 9/1970 | Georges | 280/633 |
| 3,776,567 | A | * | 12/1973 | Shimizu et al. | 280/631 |
| 4,185,582 | A | * | 1/1980 | Bryant | 116/210 |
| 4,355,817 | A | * | 10/1982 | Krob et al. | 280/605 |
| 4,506,905 | A | * | 3/1985 | Krob et al. | 280/633 |
| 4,589,674 | A | * | 5/1986 | Krob et al. | 280/633 |
| 4,986,562 | A | * | 1/1991 | Freisinger et al. | 280/633 |
| 5,261,688 | A | * | 11/1993 | Rohrmoser | 280/617 |
| 5,344,178 | A | * | 9/1994 | Rohrmoser | 280/617 |
| 5,344,179 | A | * | 9/1994 | Fritschi et al. | 280/618 |
| 5,913,532 | A | * | 6/1999 | Viodet et al. | 280/633 |
| 5,957,481 | A | * | 9/1999 | Stepanek et al. | 280/634 |
| 6,050,591 | A | * | 4/2000 | Bardin et al. | 280/633 |
| 6,092,829 | A | | 7/2000 | Mercier | |
| 6,220,619 | B1 | | 4/2001 | Rossignol | |
| 6,454,291 | B1 | * | 9/2002 | Hillairet et al. | 280/623 |
| 6,471,235 | B1 | * | 10/2002 | Luitz et al. | 280/618 |
| 2003/0001363 | A1 | * | 1/2003 | Battistella et al. | 280/618 |
| 2003/0155744 | A1 | * | 8/2003 | Gorza et al. | 280/618 |
| 2003/0209881 | A1 | * | 11/2003 | Krumbeck et al. | 280/623 |

FOREIGN PATENT DOCUMENTS

| | | | | |
|---|---|---|---|---|
| DE | 3150098 A1 | * | 7/1982 | A63C/9/00 |
| DE | 31 50 099 | | 7/1982 | |
| DE | 4033732 A1 | * | 5/1991 | A63C/9/00 |

OTHER PUBLICATIONS

Preliminary Search Report FR 0116521.

* cited by examiner

*Primary Examiner*—Brian L. Johnson
*Assistant Examiner*—J. Allen Shriver
(74) *Attorney, Agent, or Firm*—Bugnion S.A.; John Moetteli

(57) ABSTRACT

Device for adjusting the relative position between a first part, for example a ski binding heel-piece, equipped with a toothed strip (8) and a second part, for example a slide (2), equipped with two opposed sets of teeth (16, 17) collaborating with the sets of teeth (10, 11) of the strip. The sets of teeth of one of the parts are offset by a half-tooth and the teeth of the sets of teeth are truncated. The sets of teeth of the two parts come into mesh alternately on one side and the other, making it possible to have a pitch for adjustment equal to a half-tooth rather than a full tooth. The fineness of the adjustment is thus improved.

7 Claims, 2 Drawing Sheets

DEVICE FOR ADJUSTING THE POSITION OF A BINDING FOR SECURING A BOOT TO A GLIDING BOARD

BACKGROUND OF THE INVENTION

The subject of the present invention is a device for adjusting the relative position between a first part and a second part of a binding for securing a boot to a gliding board, particularly a ski, in which device the first part has a portion in the form of a strip the parallel sides of which are provided with uniform sets of teeth collaborating with sets of teeth of mating shape formed in the sides of a rectangular cutout of the second part to secure the two parts longitudinally in a selected relative position.

PRIOR ART

Such a device is used, for example, in the rear binding element for securing a ski boot or heel-piece described in U.S. Pat. No. 5,913,532, the content of which is incorporated by reference. The body of the heel-piece is mounted so that it can slide on a slide and a lock articulated to the body of the heel-piece allows the heel-piece to be immobilized on the slide. For this purpose, the lock has a part in the form of a strip equipped with two lateral sets of teeth which are symmetric relative to the axis of the strip, these sets of teeth engaging simultaneously in the sets of teeth formed in a cutout of the slide. To adjust the setting, the lock is raised by means of a lever to allow the heel-piece to be moved, then the heel-piece is locked in another position.

In such a device, the fineness of the adjustment depends obviously on the fineness of the set of teeth. Because of the thrust of the boot against the heel-piece, the teeth are subjected to a significant force and it is therefore difficult to reduce the size of the teeth without excessively weakening them. Furthermore, because of the clearances needed for inexpensive manufacture, the set of teeth can also not be to fine.

SUMMARY OF THE INVENTION

The object of the invention is to refine the adjustment without there being a need to reduce the size of the teeth.

The device according to the invention is one wherein the teeth of the sets of teeth are the shape of truncated triangles, wherein the overall width of the portion in the form of a toothed strip of the first part is equal to the distance separating the sets of teeth of the second part increased by the height of one tooth and wherein at least the teeth of the sets of teeth of one of the parts are longitudinally offset by a value such that when, on the one hand, the corresponding sets of teeth are engaged in one another, the opposed sets of teeth come into contact via the truncated ends of their teeth.

The equality mentioned hereinabove has of course to be understood as being approximate, given the clearances needed for easy engagement and disengagement and for manufacture that allows relatively broad tolerances.

For the purposes of simplifying manufacture, the opposed sets of teeth of one of the parts are preferably symmetric relative to the axis of this part, while the other sets of teeth are offset with respect to one another by the value of half a tooth. This condition is not, however, essential.

It is thus possible for one of the parts to be moved with respect to the other by the value of half a tooth. In such a movement, the two parts will move transversely one with respect to the other by the height of one tooth, because it is the other two sets of teeth which come into mesh, while the teeth of the sets of teeth previously in mesh will become positioned one facing the other, truncated face against truncated face. In order to allow this transverse or approximately transverse movement, one of the parts may have a transverse clearance corresponding to the height of a tooth or may be mounted so as to pivot about a vertical axis via an end distant from the toothed part.

The device according to the invention will mainly find an application in a heel-piece of the type described in U.S. Pat. No. 5,913,532 or U.S. Pat. No. 6,220,619, the content of which is incorporated by reference, but it is possible to use it in other arrangements, for example in a ski binding with symmetric adjustment such as described in U.S. Pat. No. 5,261,688, the content of which is incorporated by reference and U.S. Pat. No. 6,092,829, the content of which is incorporated by reference.

According to an embodiment applied to a ski binding heel-piece comprising a body mounted on a slide, the first part is a strip articulated to said body and the second part is the slide itself.

BRIEF DESCRIPTION OF THE DRAWINGS

The drawing depicts, by way of example, one embodiment of the invention.

DESCRIPTION OF THE PREFERRED EMBODIMENT

Figure 1:
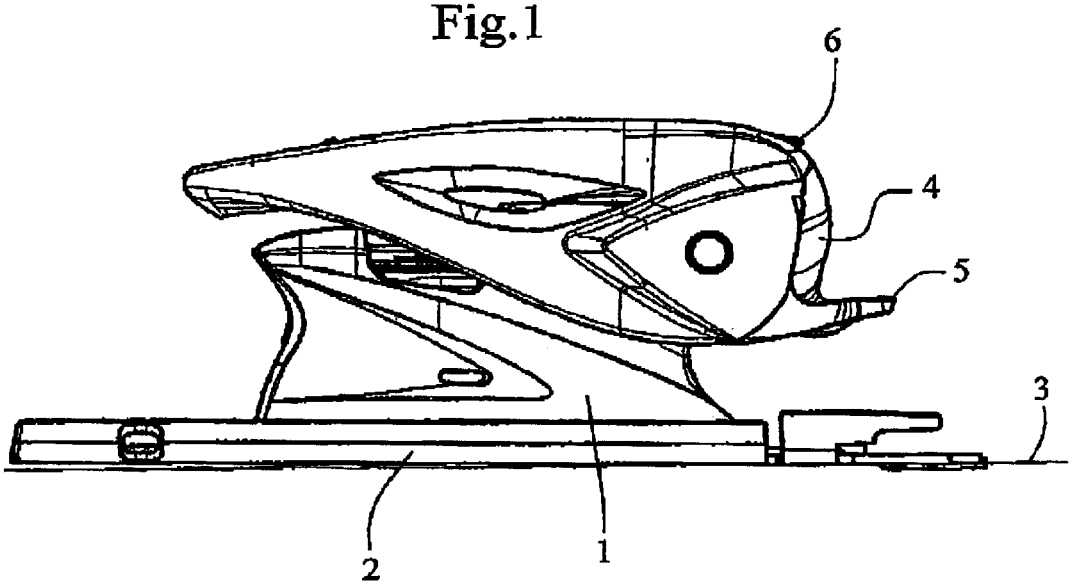
FIG. 1 is a view in side elevation of a heel-piece.
Figure 2:
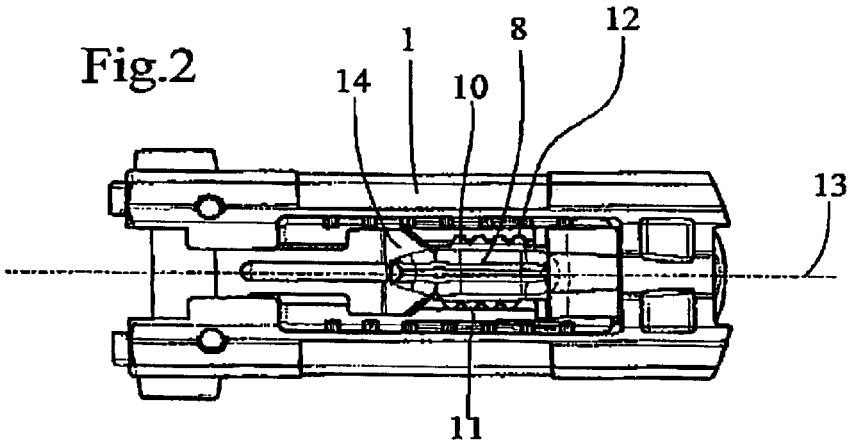
FIG. 2 is a view from beneath of the body of the heel-piece, without the slide.

FIG. 1 depicts a heel-piece of known design in the open position. This heel-piece comprises a body 1 mounted on a slide 2 itself fixed by means of screws to a ski 3. Mounted on the body 1 is a retaining element 4 of which the pedal 5 and the jaw 6 intended to bear against the rear curb of a boot in order to hold the heel of the boot on the ski can be discerned.

Mounted in the lower part of the body 1 of the heel-piece is a strip 8 connected by an end 9 (FIG. 3) to the body 1 so as to be able to pivot in a vertical plane, that is to say perpendicular to the plane of the ski, and so as to have a clearance in a direction transverse to the slide 2. The strip 8 has, on its parallel sides, two opposed sets of teeth 10 and 11 the uniform teeth of which, which initially were of triangular shape, are truncated so as to exhibit a flat apex face 12. Furthermore, the sets of teeth 10 and 11 are not symmetric relative to the longitudinal axis 13 of the heel-piece and of the slide, but are offset longitudinally parallel to this axis 13 by the value of half a tooth, that is to say by a length equal to half the pitch of the set of teeth. Thus, if a perpendicular to the axis 13 passing through a trough of one of the sets of teeth is dropped, this perpendicular passes through the middle of the face 12 of a tooth of the opposite set of teeth. The strip 8 is also equipped with a bent portion 14 rising up above the slide, that is to say inside the body 1. When the heel-piece is mounted on the slide, this portion 14 is accessible and allows the strip to be raised to carry out a position-adjustment.

For its part, the slide 2 has a longitudinal rectangular cutout 15 the sides of which exhibit two opposed sets of teeth 16 and 17 which are symmetric relative to the axis 13 of the slide. The teeth of these sets of teeth 16 and 17 have the same shape, the same pitch and the same size, give or take the clearance, as the sets of teeth 10 and 11 of the strip 8. In addition, the overall width of the toothed portion of the strip 8 is equal to the distance separating the sets of teeth 16 and 17 of the slide 2 increased by the height of a tooth of the strip, less the clearance needed for inexpensive manufacture and ease of handling.

Figure 3:
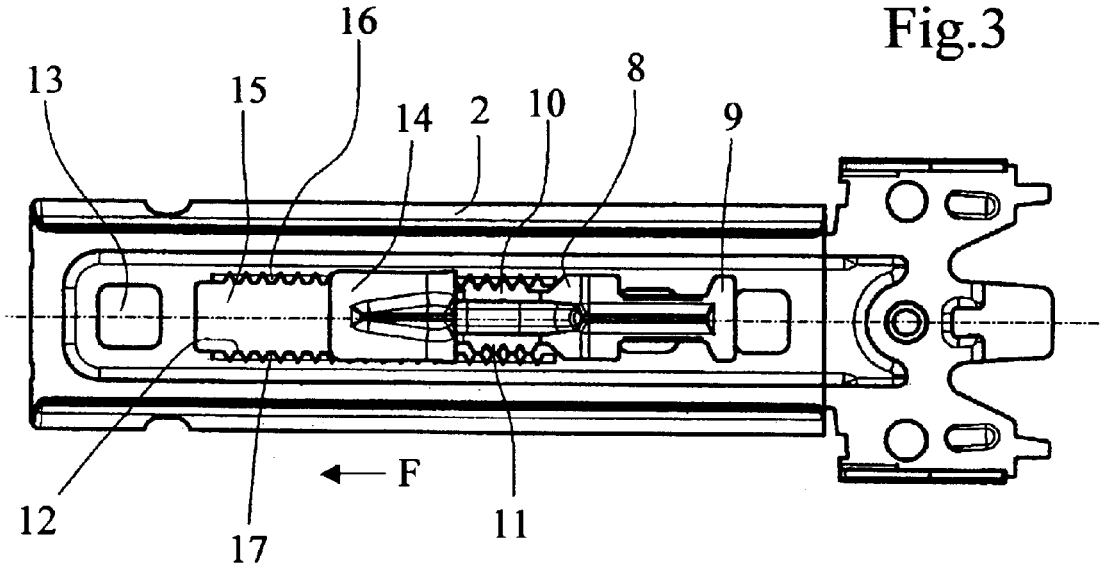
FIG. 3 is a view from above of the slide and of the strip connected to the body of the heel-piece in a first position.

When the toothed portion of the strip 8 is engaged in the cut-out 15 of the slide 2, the strip for example occupies the position depicted in FIG. 3. In this position, the set of teeth 10 of the strip is engaged in the set of teeth 16 of the slide, but because of the offset of the sets of teeth 10 and 11 of the strip, the teeth of the set of teeth 11 are positioned facing the teeth of the set of teeth 17 of the slide. The facets 12 of the teeth of the set of teeth 11 therefore butt against the corresponding facets of the teeth of the set of teeth 17 so that the strip is immobilized in this position and so that the heel-piece occupies a first position on the slide 2.

Figure 4:
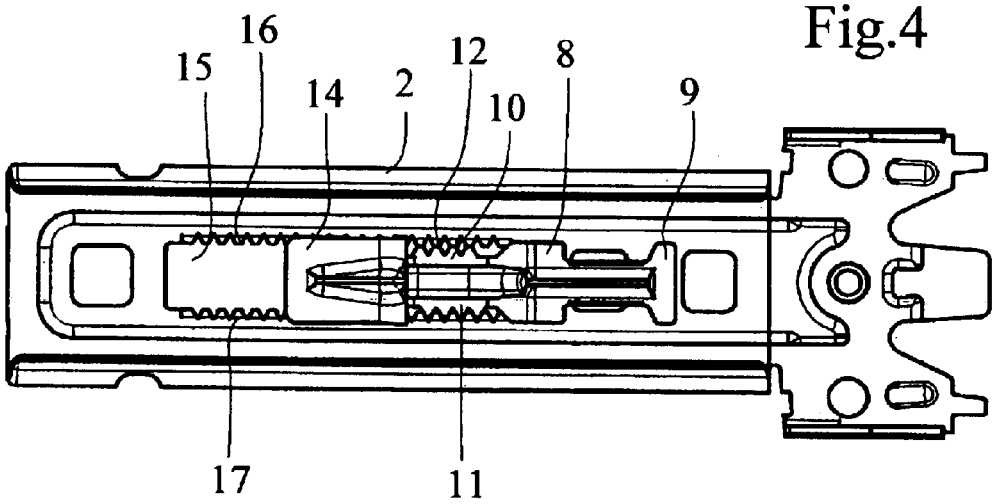
FIG. 4 is a view similar to that of FIG. 3 with the strip in another position offset by a half-tooth relative to the position depicted in FIG. 3.

A spring, not depicted, returns the strip 8 vertically downward into a position in which its teeth are engaged with those of the slide. Thus, to move from the position depicted in FIG. 3 to the position depicted in FIG. 4 the strip 8 is raised by its portion 14 and the heel-piece is moved backward very slightly along the slide 2, that is to say in the direction of the arrow F, releasing the strip 8 which re-engages in the slide so that its set of teeth 11 engages in the set of teeth 17 of the slide while the teeth of its set of teeth 10 become positioned facing the teeth of the set of teeth 16. The strip 8 is moved transversely by the height of one tooth. By taking as reference the sets of teeth 16 and 17 of the slide, it can therefore be seen that the strip 8 has been moved by the value of half a tooth, that is to say by half a pitch of the sets of teeth 16 and 17. The spring bears against the body 1 and exerts a roughly vertical force on the strip 8 which means that the strip engages in the teeth situated to right or to left of the slide without being detracted from either of these positions by the return force.

As already stated above, it is obvious that the strip 8 could have symmetric sets of teeth and that the slide could have offset sets of teeth.

The principle of adjustment by offset sets of teeth described hereinabove in the case of a heel-piece mounted on a slide can be applied to other types of ski binding. It is applicable in particular in ski bindings comprising front and rear binding elements that can be moved symmetrically to adapt them to suit different boot sizes, the binding elements being mounted on supports each equipped with a rack and driveable symmetrically by a central pinion, as described, for example, in U.S. Pat. No. 5,261,688 and U.S. Pat. No. 5,261,688 or by means of several pinions as described in U.S. Pat. No. 6,092,829. At least one of the racks may be connected to the corresponding support by teeth similar to the teeth described in the case of a heel-piece.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed:

1. A device for adjusting the relative position between a first part (1) and a second part (2) of a binding for securing a boot to a gliding board, in which device the first part (1) has a portion in the form of a strip (8) the parallel sides of which are provided with a uniform first set of teeth (10, 11) collaborating with a second of teeth (16, 17) of mating shape formed in the sides of a rectangular cutout (15) of the second part (2) to secure the two parts longitudinally in a selected relative position, wherein the teeth of the first and second sets of teeth (10, 11, 16, 17) are the shape of truncated triangles, wherein the overall width of the portion in the form of the strip (8) of the first part (1) is equal to the distance separating the second set of teeth (16, 17) of the second part decreased by the height of one tooth and wherein at least the teeth of the first set of teeth (10, 11) of one of the parts are longitudinally offset by a value such that when one side of the corresponding first and second sets of teeth are engaged in one another, the opposed first and second sets of teeth on the opposite side come into contact via the truncated ends of their teeth.

2. The device as claimed in claim 1, wherein the first set of teeth (10, 11) of one of the parts are asymmetric relative to the longitudinal axis of the slide and wherein the second set of teeth (16, 17) of the other part are symmetric, the asymmetric first set of teeth (10, 11) being offset longitudinally by a half tooth with respect to one another.

3. The device as claimed in claim 1, wherein one of to parts is mounted so that it can pivot about an axis perpendicular to the plane of the slide.

4. The device as claimed in claim 2, wherein one of the parts is mounted so that it can pivot about an axis perpendicular to the plane of the slide.

5. The device as claimed in claim 1, wherein one of the parts has a transverse clearance corresponding to the height of one tooth of the sets of teeth.

6. The device as claimed in claim 2, wherein one of the parts has a transverse clearance corresponding to the height of one tooth of the sets of teeth.

7. The device as claimed in claim 1, applied to a heel-piece of a ski binding comprising a body mounted a slide, wherein the first part is the strip (8) articulated to said body and wherein the second part comprises the slide.

* * * * *